United States Patent [19]

Symborski

[11] 4,191,079

[45] Mar. 4, 1980

[54] TEXTILE STRAND CONTROL DEVICE

[75] Inventor: Alex P. Symborski, Anderson, S.C.

[73] Assignee: Owens-Corning Fiberglas Corporation, Toledo, Ohio

[21] Appl. No.: 937,005

[22] Filed: Aug. 25, 1978

[51] Int. Cl.[2] ..... D01G 1/04

[52] U.S. Cl. ..... 83/347; 29/121.5; 83/438; 83/913; 226/190; 226/193

[58] Field of Search ..... 226/190, 193; 29/121.5; 83/346, 347, 438, 913

[56] References Cited

U.S. PATENT DOCUMENTS

| | | | |
|---|---|---|---|
| 3,265,482 | 8/1966 | Langlois et al. | 226/193 X |
| 3,506,419 | 4/1970 | Smith et al. | 226/193 X |
| 3,826,418 | 7/1974 | Gelin | 29/121.5 X |
| 3,981,129 | 9/1976 | Briaire | 226/190 X |

*Primary Examiner*—J. M. Meister

*Attorney, Agent, or Firm*—Ronald C. Hudgens; Philip R. Cloutier; Greg Dziegielewski

[57] ABSTRACT

An idler roll adapted to engage a moving textile strand is comprised of a plurality of substantially parallel, spaced apart cylindrical rods positioned along a base circle wherein the diameter of the base circle, the diameter of the cylindrical rods and the distance measured along the base circled between the center lines of adjacent rods are determined according to specific predetermined relationships.

4 Claims, 3 Drawing Figures

TEXTILE STRAND CONTROL DEVICE

BACKGROUND OF THE INVENTION

Generally, in any textile operation there can be a problem with the strands wrapping about an idler roll. This unintentional "roll wrap", as is known in the art, is especially prevalent when handling strands having a liquid on the surface thereof since the liquid has a tendency to act as an adhesive between the surface of the idler roll and the advancing strand.

A number of different idler roll designs have been developed but the problem still persists. Plain cylindrical surfaces have been used as well as cylinders having a series of parallel grooves located parallel to the axis of rotation thereon, similar to a spline or gear. Also an idler roll having a series of substantially parallel rods partially embedded in a surface of a cylinder have been used for positioning a strand as set forth in U.S. Pat. No. 3,265,482 issued to R. E. Langlois et al.

Obviously, a device that reduces the tendency of a strand to roll wrap is desireable since a roll wrap generally results in a loss of production during the time it takes to clear the fouled roll and restart the process.

SUMMARY OF THE INVENTION

This invention pertains to a device adapted to engage a moving textile strand wherein the device is comprised of a plurality of substantially parallel, spaced apart cylindrical rods adapted to contact the strands, the rods being positioned along a base circle wherein the diameter of the base circle, the diameter of the rods and the distance measured along the base circle between the center lines of adjacent rods are determined according to preselected relationships to reduce the tendency of the strand to roll wrap.

It is an object of this invention to provide an idler roll having a reduced tendency to roll wrap over that achieved by the prior art systems, especially systems wherein the idler roll contacts a strand having a liquid thereon.

The foregoing, as well as other objects of the present invention, will become apparent to those skilled in the art from the following detailed description.

DESCRIPTION OF THE PREFERRED EMBODIMENTS

As pointed out before, the tendency of a strand to roll wrap is greatly enhanced wherein a liquid is present upon the surface of the strand. One process operating under such conditions is the process used to produce chopped glass filaments directly from a strand or bundle of glass filaments being attenuated from a bushing or feeder.

Figure 1:
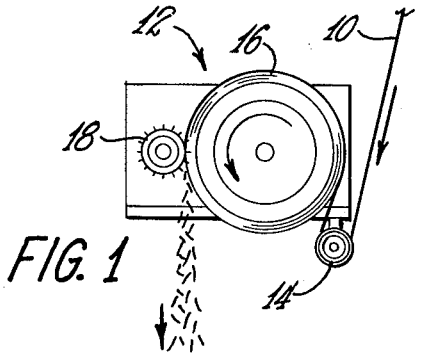
FIG. 1 is a front view of a device for chopping continuous glass filaments into shorter segments.
Figure 2:
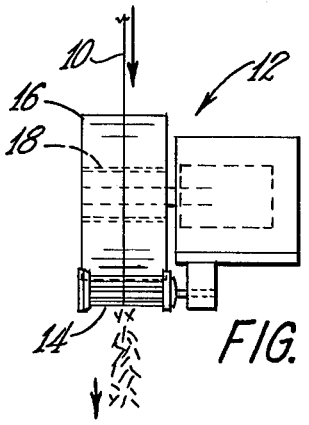
FIG. 2 is a side view of the device shown in FIG. 1.

In such a process, a plurality of individual filaments are attenuated from a bushing supplying a plurality of streams of molten inorganic material, such as glass, from the bottom wall of a bushing containing a body of molten material as known in the art. The streams of molten material are attenuated into filaments by the action of the cot wheel 16 on chopper 12 as is shown in FIG. 1. Between the bushing and the gathering shoe, which gathers the individual filaments into a bundle or strand, a liquid, such as a size and/or water, can be applied to the filaments as is known in the art.

The cot roll 16 and idler roll 14, which is spaced from cot roll 16, have substantially parallel axes of rotation, and are oriented to position the strand 10 over a predetermined path or section of cot roll 16 to ensure a non-slipping engagement between the strand and the cot roll.

As the driven cot roll rotates, the strand in contact therewith passes between mutually engaging portions of the cot roll 16 and cutter roll 18. The blades of the cutter roll 18 penetrate the elastomeric surface of the cot roll 16 to chop the continuous filaments into individual segments. A typical system for producing chopped strand from continuous glass filaments is shown in U.S. Pat. No. 3,508,461 issued to R. M. Stream.

Figure 3:
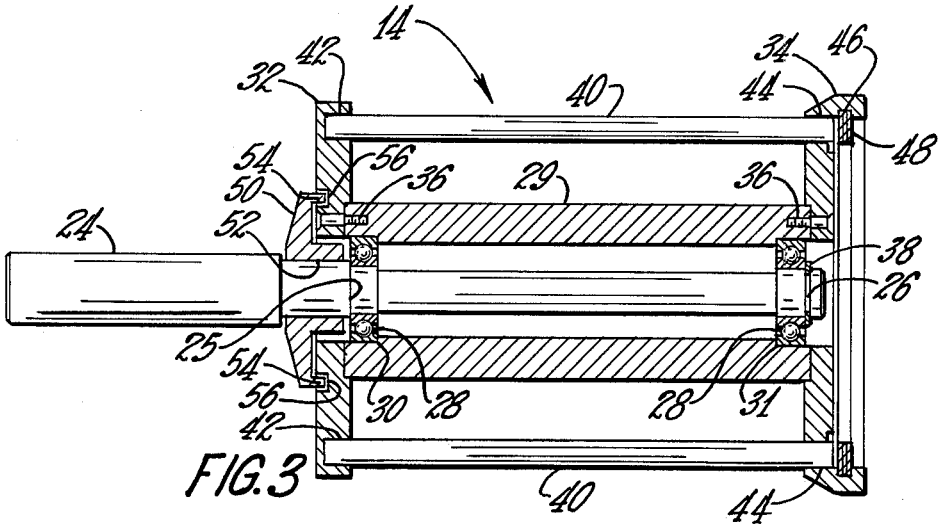
FIG. 3 is a sectional side view of the idler roll incorporated in FIGS. 1 and 2.

As shown in FIG. 3 idler roll 14 is comprised of shaft 24 having bearings 28 located thereon. One end of shaft 24 is adapted to be rigidly fixed with respect to cot roll 16, such as by suitably fastening the said end of shaft 24 to a common frame.

One bearing 28 butts against shoulder 25 of shaft 24 to axially locate such bearing along the shaft. The other bearing 28 is axially located in the opposite direction by means of retainer or lock ring 38 registered in groove 26 of shaft 24. The outer races of bearings 28 are registered in core or sleeve 29 and butt against shoulders 30 and 31 thereof to maintain the bearings in a spaced apart relationship.

At one end of sleeve 29, first flange or member 32, which extends radially outward from shaft 24, is suitably fastened to the sleeve 29 by means of screws or fasteners 36. At the opposite end of sleeve 29, a second flange or member 34 is similarly fastened to sleeve 29 by means of screws or fasteners 36. The cylindrical rods or elements 40 are positioned along a base circle at the circumference of the idler roll according to a predetermined relationship which will be explained in more detail later. The center of the base circle is located along the axis of rotation of the idler roll with the base circle positioned in a plane substantially perpendicular to the axis of rotation.

One end of any given cylindrical rod 40 is registered in one of the plurality of recesses 42 extending partially through first flange 32 along the base circle. The opposite end of rod 40 is registered in aperture 44 extending through second flange 34 located along an identical base circle. The axial centerline of any rod 40 is substantially perpendicular to the plane containing the base circles and intersects the base circle. A retainer means such as retaining ring 48 which is registered in groove 46 of second flange 34 is positioned to prevent rods 40 from substantial axial displacement. Obviously the recess and aperture are located along the base circle.

Thus, sleeve 29, first flange 32, second flange 34 and cylindrical rods 40 are rotatable with respect to shaft 24 which can be adapted to be fixed and positioned as desired. According to this invention rods 40 are simply supported, that is fastened only at each end thereof, or the rods can be cantilevered from the first flange as will be explained later.

As shown in FIG. 3 sheath 50 is press fit at aperture 52 thereof to shaft 24, and tongue 54 of sheath 50 is received by groove 56 of first flange 32 to partially protect inboard bearing 28 from foreign substances.

Since during operation the first flange 32 will be rotating and sheath 50 will be stationary, a suitable clearance between sheath 50 and flange 32 must be maintained.

According to this invention the plurality of rods 40 are sized and located according to predetermined relationships to provide an idler roll having an unexpected but substantially reduced tendency for the textile strand to wrap there around.

To reduce the tendency of the strand to wrap around the idler roll, it is believed that where "D" is equal to the diameter of the base circle through which the center line of each rod passes, "d" is equal to the outside diameter of the rods, and "S" is equal to the distance measured along the base circle between the center lines of adjacent rods. The idler roll should be designed such that "d" is less than or equal to 0.08D and "S" is greater than or equal to 1.6d. Preferably $0.06D \leqq d \leqq 0.08D$ and $2.0d \geqq S \geqq 1.6d$ to provide a proper spacing between the rods which are radially spaced away from any surface a sufficient distance from the axis of rotation of the idler roll and from adjacent rods to allow the ambient air to wipe the surfaces of the rods clean and to promote turbulent air flow around these surfaces of the rods.

It is possible to design an idler roll not having a core or sleeve 29 as shown in FIG. 3. However, where a sleeve 29 is employed between the rods and along the axis of rotation of the idler roll wherein "x" is equal to the outside diameter of the sleeve, "x" should be less than or equal to 0.65D.

Included within the scope of this invention is an idler roll not having a central sleeve. As such the inboard end of the shaft can be journaled for rotation in the frame of the chopper with the first flange being rigidly fastened to the shaft. The flange extends radially outward from the distal end of the shaft and the rods are located substantially parallel to the axis of rotation and to each other along the base circle according to the foregoing equations. Thus the idler roll can have cantalevered rods. A second flange may or may not be fastened to the rods to retain the opposite ends of the rods at the same relative radial distance from the axis of rotation of the idler and between each other.

The idler rolls described herein can be made of any suitable material such as stainless steel and can be used to where an idler roll is necessary to control the advancement of a textile strand.

It is apparent that within the scope of the invention, modifications and different arrangements can be made other than as herein diclosed. The present disclosure is merely illustrative with the invention comprehending all variations thereof.

I claim:

1. A rotatable member adapted to engage a moving textile strand comprising:

a plurality of substantially parallel, spaced apart cylindrical rods adapted to contact said strand, the rods being positioned along a base circle wherein D=diameter of the base circle d=diameter of the rods S=distance measured along the base circle between centerlines of adjacent rods and said member is fabricated according to the following parameters $d < 0.08D$ $S > 1.6d$.

2. A chopper adapted to cut continuous strand into individual segments comprising:

a rotatable cot roll;

a rotatable cutter roll having a plurality of cutting edges adapted to cut said strand passing between the cutter roll and cot roll; and a rotatable idler roll adapted to position the strand on at least a portion of the circumferential periphery of the cot roll, the idler roll having a plurality of substantially parallel, spaced apart cylindrical rods adapted to contact said strand, the rods being positioned along a base circle wherein D=diameter of the base circle d=diameter of the rods S=distance measured along the base circle between centerlines of adjacent rods and said idler roll is fabricated according to the following parameters $d \leqq 0.08D$ $S \geqq 1.6D$.

3. The member of claims 1 or 2 wherein $0.06D \leqq d \leqq 0.08D$ and $2.0d \geqq S \geqq 1.6d$.

4. The member of claim 3 further including a sleeve between said rods along the axis of rotation of said member wherein X=diameter of the core, and $X \leqq 0.65D$.

* * * * *